US005756912A

United States Patent [19]

Liao

[11] Patent Number: 5,756,912

[45] Date of Patent: May 26, 1998

[54] ANGLE ADJUSTMENT DEVICE FOR CYMBAL MOUNTING FRAMES

[75] Inventor: Tusn-Chi Liao, Taichung, Taiwan

[73] Assignee: Hwa Shin Musical Instrument Co. Ltd., TaiChung, Taiwan

[21] Appl. No.: 769,073

[22] Filed: Dec. 18, 1996

[51] Int. Cl.[6] ..... G10D 13/02

[52] U.S. Cl. ..... 84/421

[58] Field of Search ..... 84/402, 403, 421, 84/422.1, 422.2, 422.3

[56] References Cited

U.S. PATENT DOCUMENTS

| | | | |
|---|---|---|---|
| 4,126,075 | 11/1978 | Kurosaki | 84/421 |
| 4,747,569 | 5/1988 | Hoshino | 84/421 |
| 4,796,508 | 1/1989 | Hoshino | 84/421 |
| 4,800,795 | 1/1989 | Yamashita | 84/421 |
| 5,467,680 | 11/1995 | Kurosaki | 84/421 |

*Primary Examiner*—Michael L. Gellner
*Assistant Examiner*—Daniel Chapik
*Attorney, Agent, or Firm*—Bacon & Thomas

[57] ABSTRACT

An improved angle adjustment device for cymbal mounting frames includes an adjusting seat with an annular seat in which a connecting means may slidably rotate to achieve stepless angle adjustment of a cymbal mounted on the adjusting seat. The angle of the cymbal may be firmly set after adjustment.

3 Claims, 8 Drawing Sheets

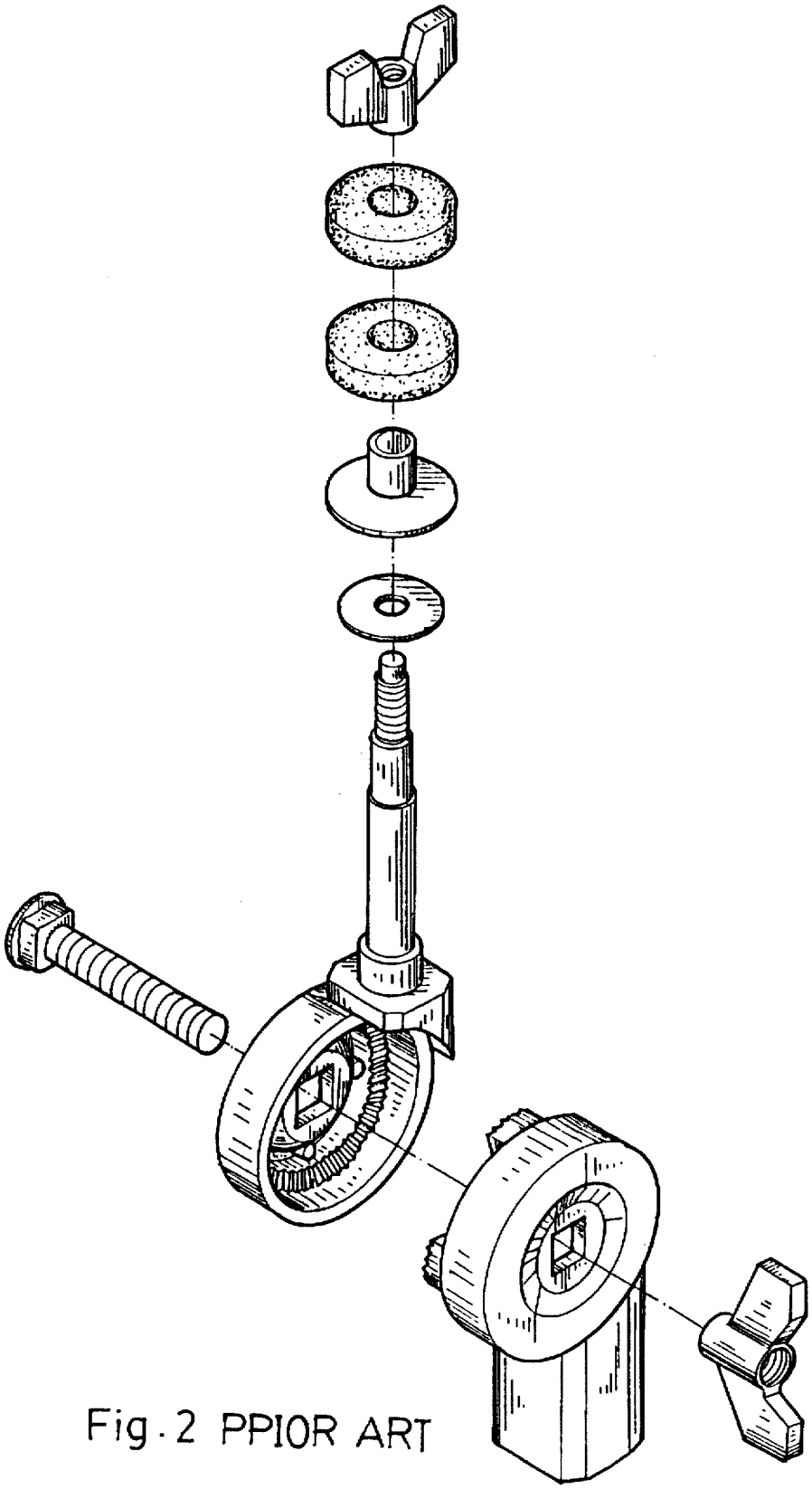
Fig. 2 PPIOR ART

ANGLE ADJUSTMENT DEVICE FOR CYMBAL MOUNTING FRAMES

BACKGROUND OF THE INVENTION

The present invention relates generally to a musical instrument, and more particularly to an improved angle adjustment device for cymbal mounting frames which may be used in adjusting the angle between the mounting frame and the cymbal.

FIG. 1 shows a conventional cymbal mounting frame. An angle adjustment device is disposed at a top end of the cymbal mounting frame. Referring to FIG. 2, the angle adjustment device essentially comprises a first seat and a second seat, the first seat including a circular block having one side thereof sunken to a certain depth and providede with a toothed ring. The circular block is joined to a connecting block having a rod disposed above. An upper section of the rod is provided with external threads. A positioning element and two cotton pads for holding a cymbal therebetween are fitted onto the rod in sequence from above. A wing nut is lastly fitted onto the threaded section of the rod. circular block with an inner side provided with a plurality of protrudent toothed blocks so that the two seats may be coupled by fitting the toothed blocks and the toothed ring. A securing element is axially passed through the seats to secure them together. A bottom side of the second seat is provided with a sleeve for fitting onto the cymbal mounting frame.

By means of the above-described angle adjustment device, the cymbal mounting frame may be adjusted to a proper angle. In use, the securing element has to be released first so that the two seats may be separated from each other. After turning one of the seats to a desired angle, the securing element is locked in place again. But since the seats are joined by means of the toothed ring and the toothed blocks, while relatively good positioning effect may be achieved, it is not possible to obtain stepless angle adjustment. It is often necessary to deviate the desired angle a little bit so as to accommodate the toothed ring and the toothed blocks. Worse still, if the adjustment device is turned prior to the disengagement of the toothed ring and the toothed blocks of the two seats, the teeth may be damaged, thus affecting the positioning effect. It can therefore be seen that there are various setbacks with the conventional angle adjustment device in terms of operation, angle adjustment and positioning.

SUMMARY OF THE INVENTION

A primary object of the present invention is to provide an improved angle adjustment device for cymbal mounting frames to achieve stepless angle adjustment of the cymbal in a convenient way, so that micro-adjustment, precision of angles, sure positioning may be accomplished.

Another object of the present invention is to provide an angle adjustment device for cymbal mounting frames whereby no components may become loosened or displaced during angle adjustment.

In order to achieve the aforementioned objects, the present invention essentially comprises an adjusting seat having a hollow annular seat at a top side thereof, the annular seat being provided with teeth at its inner rim for matching a cylindrical connecting means axially inserted into the annular seat; and a curved slide block slidable on a slide edge at a top side of the annular seat and having a central through hole for passage of a central shaft fitted with a cymbal and its securing structure, a bottom end of the curved slide block being connected to the connecting means. By means of the arrangement of the connecting means and the stepless slidable rotation of the annular seat, stepless angle adjustment may be achieved. After the angle is set, by using a wing screw to push a push block to press against one side of the connecting means, the connecting means may be secured in place by the teeth and the push block.

BRIEF DESCRIPTION OF THE DRAWINGS

FIG. 2 is an elevational exploded view of an angle adjustment device for a cymbal mounting frame;

DETAILED DESCRIPTION OF THE PREFERRED EMBODIMENT

Figure 1:
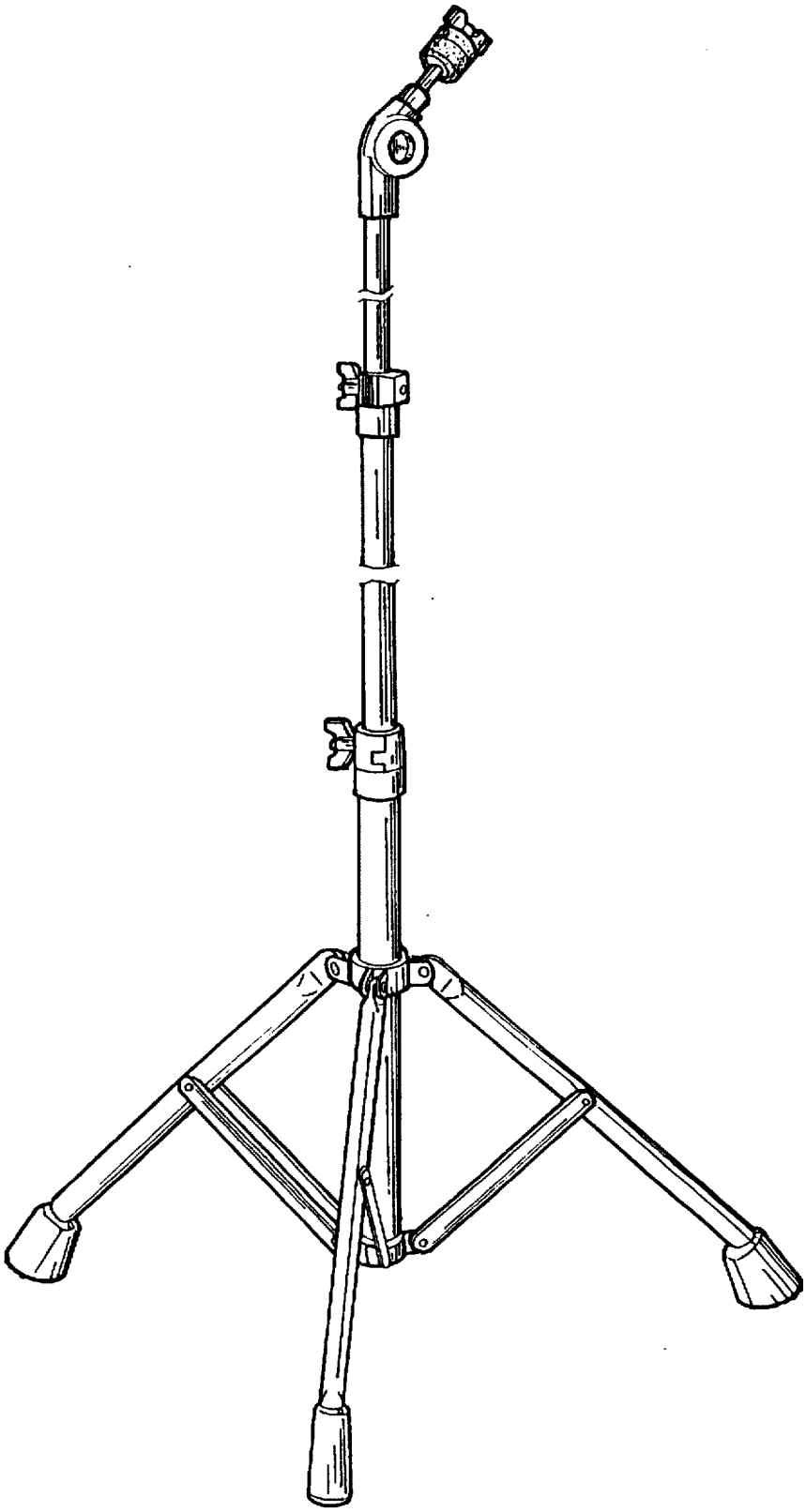
Fig. 1 PRIOR ART
FIG. 1 is an elevational view of a conventional cymbal mounting frame.
Figure 3A:
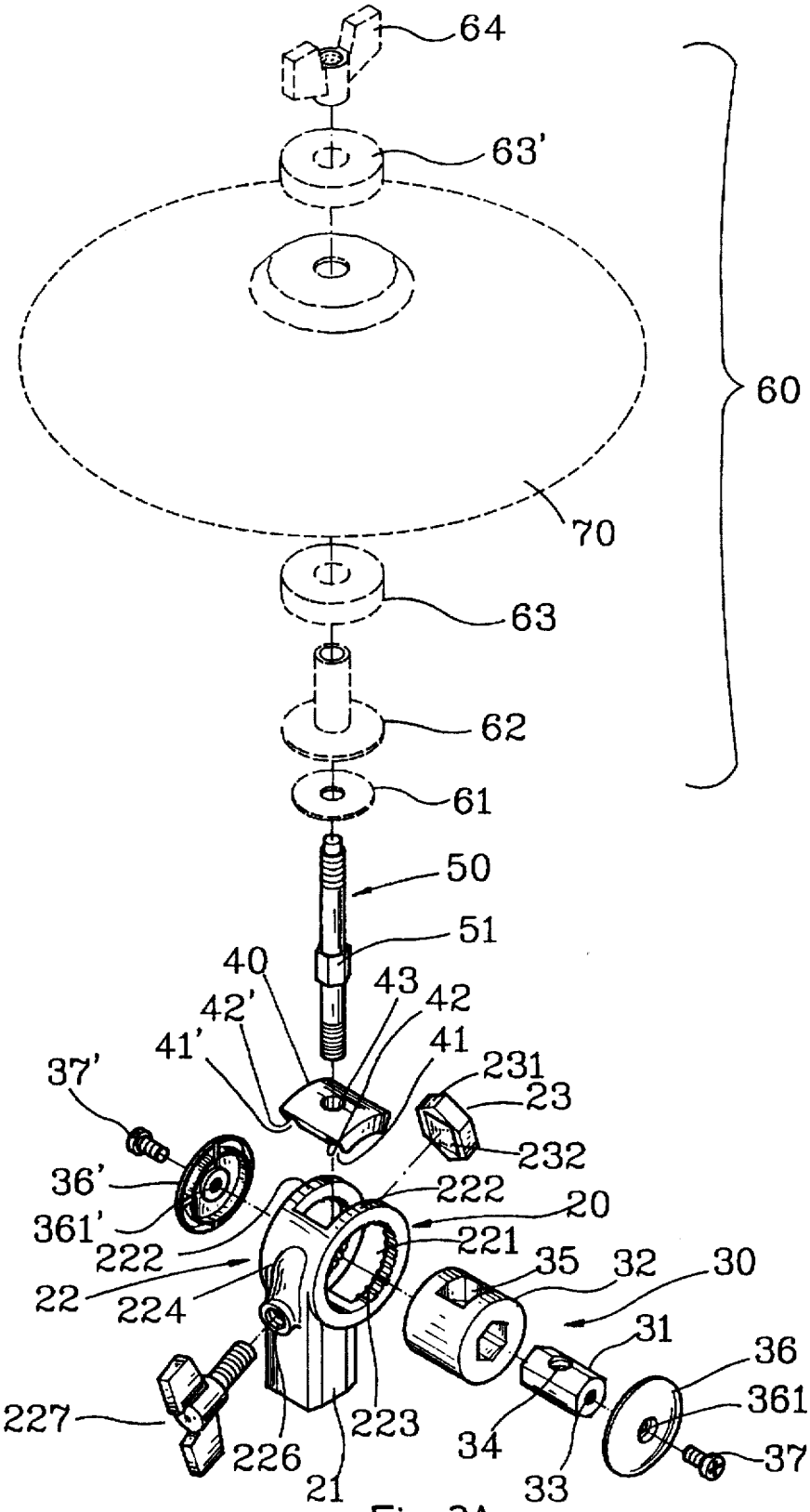
FIG. 3A is an elevational exploded view of the present invention.
Figure 3B:
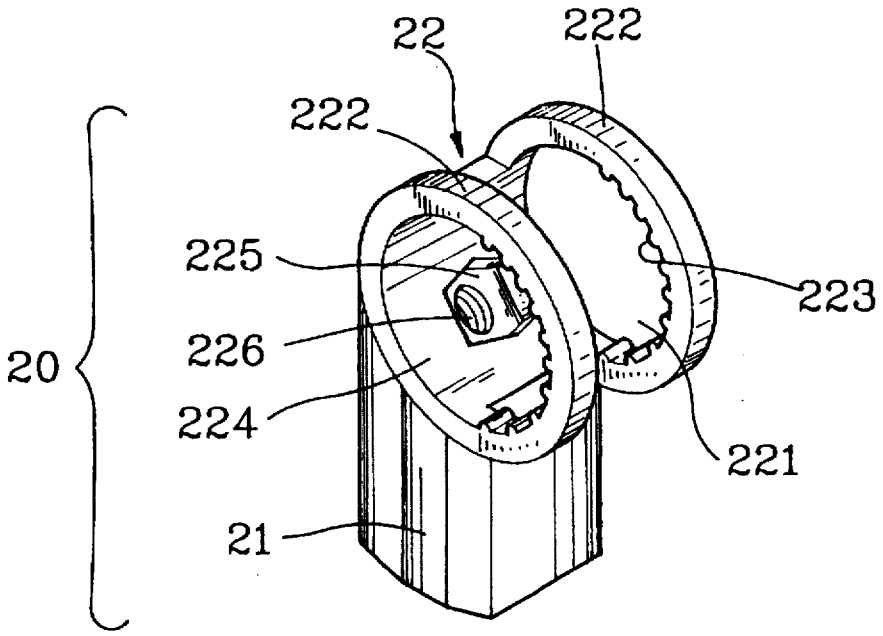
FIG. 3B is an elevational rear view of the adjustment seat according to the present invention.
Figure 3C:
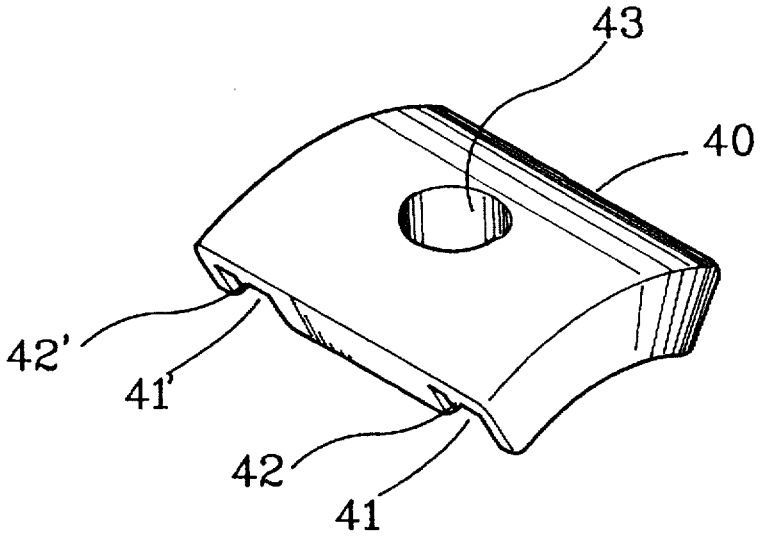
FIG. 3C is an elevational view of the slide block according to the present invention.
Figure 4:
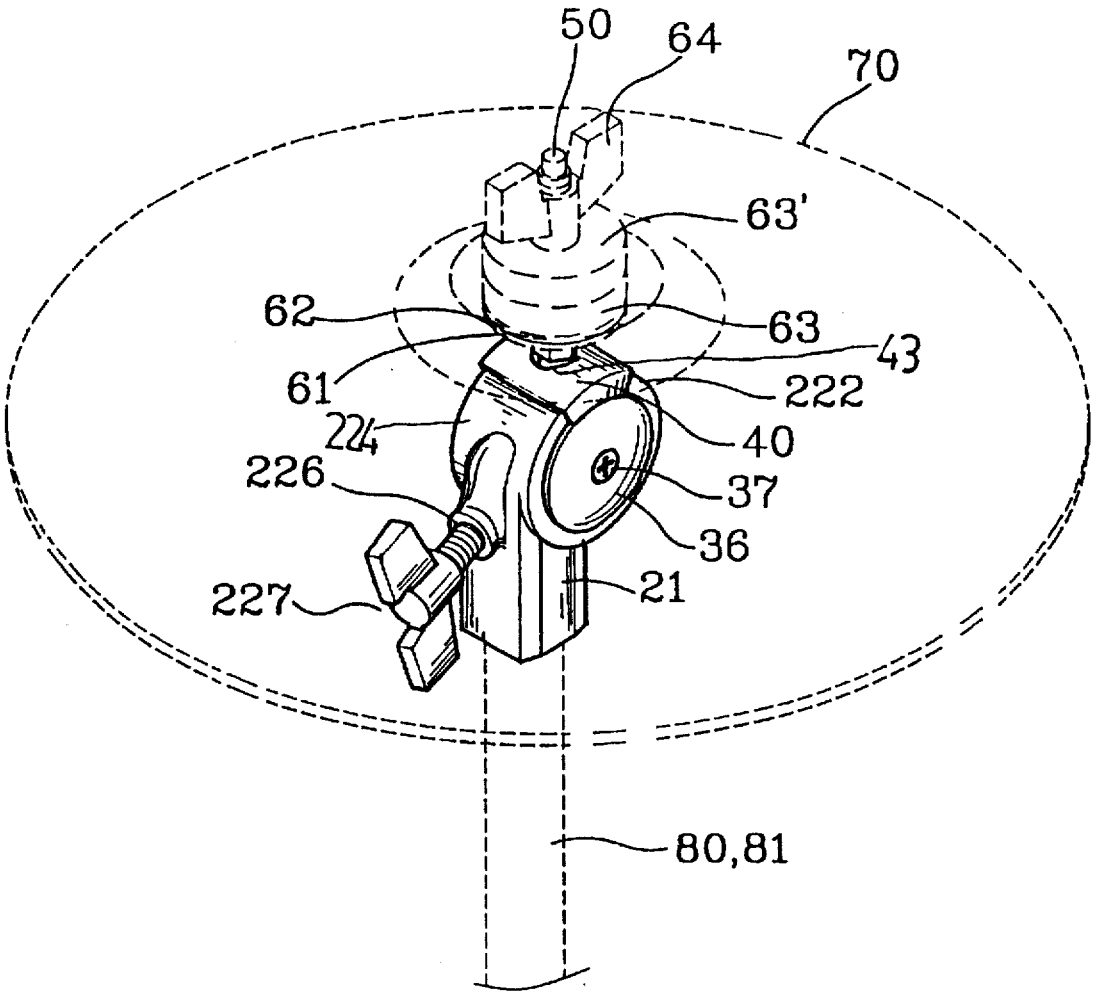
FIG. 4 is a schematic assembled view of the present invention.
Figure 5:
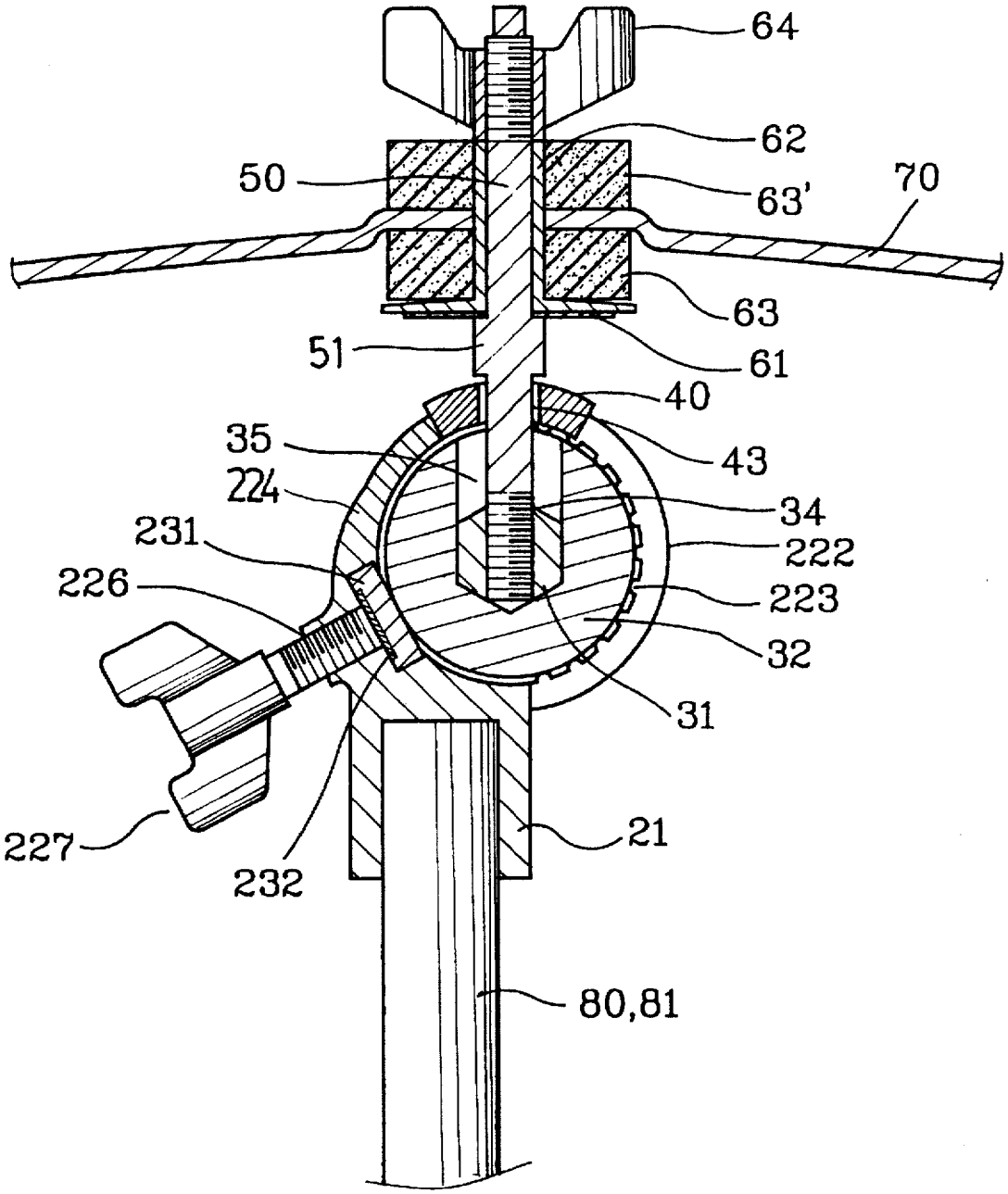
FIG. 5 is a sectional assembled view of the present invention.

With reference to FIGS. 3 to 5, the angle adjustment device according to the present invention essentially comprises an adjusting seat 20, a connecting means 30, a slide block 40, and a central shaft 50.

The adjusting seat 20 essentially comprises a hollow sleeve portion 21. At a top side of the sleeve portion 21 is eccentrically provided a hollow annular seat 22. The peripheral surface of the annular seat 22 is provided with a large-proportion open slot 221 so that two slide edges 222 are formed at the respective sides thereof and a closed portion 224 is further formed at a peripheral side of the annular seat 22. The inner rims of the respective slide edges 222 are provided with teeth 223. The closed portion 224 is provided with a positioning groove 225 at an inner rim and a protrudent orifice portion 226 at an outer rim. The orifice of the orifice portion 226 communicates with the positioning groove 225. A wing screw 227 having a plurality of external threads is screwably fitted into the orifice 226. The positioning groove 225 is internally provided with an urging element 23 including a aluminum push block 231 enclosing a piece 232 made of iron. The piece 232 provides a better structural strength when it is pushed by an end of the screw bolt 227. The connecting means 30 essentially comprising a metal polygonal post 31 wrapped tightly in a cylindrical protective jacket 32 made of rubber or plastics material of a predetermined thickness. Both ends of the polygonal post 31 are respectively provided with an internally threaded connecting hole 33, and the central portion of the top side of the polygonal post 31 is provided with an internally threaded securing hole 34. The protective jacket 32 is provided with a hole 35 with respect to the securing hole 24 and communictaing therewith. The connect element 30 is axially inserted into the annular seat 22, with the teeth 223 of the annular seat 22 contacting the two end surfaces of the protective jacket 32. The respective ends of the connecting means 30 are slidably provided with a sealing cover 36 (36') with respect to the outer surfaces of the two slide edges 222. The sealing covers 36, 36' are each provided with a hole 361 (361') at a central portion thereof for passage of an externally threaded connecting element 37 (37') therethrough, locking the connnecting holes 33 of the polygonal post 31, and securing the two sealing covers 36, 36' onto the ends of the connecting means 30 such that the sealing covers 36, 36' cover the outer surfaces of the two slide edges 222 of the annular seat 22 and protect the ends of the connecting means 30.

The slide block 40 is substantially curved and is slidable along the slide edges 222 of the annular seat 22. A bottom side of the slide block 40 is provided with two grooves 41, 41' at predetermined positions with respect to the slide edges 222. The grooves 41, 41' each have at least one resisting boss 42 (42') disposed at a suitable position therein so that the grooves 41, 41' may fit onto the slide edges 222 and slidably displace directionally along the slide edges and, when they are positioned, the resisting bosses 42, 42' may increase the frictional force to prevent the slide block 40 from sliding freely. The slide block 40 further has a central through hole 43 for passage of a bottom end of the central shaft 50 therethrough.

The central shaft 50 has a projecting block 51 of an enlarged diameter disposed at a suitable position at a middle section thereof, and a plurality of external threads at either end thereof. The bottom end of the central shaft 50 passes through the through hole 43 of the slide block 40 and the hole 35 of the protective jacket 32 to lock with the securing hole 34 of the polygonal post 31. The upper section above the projecting block 51 of the central shaft 50 has a cymbal securing means 60 assembled thereto. The securing means 60 is a conventional structure, including a packing 61 having a bottom side abutting an upper end of the projecting block 51, a sleeve element 62 disposed above the packing 61, and two cotton pads 63, 63' having a cymbal 70 sandwiched therebetween. The top end of the central shaft 50 is lockably connected to a wing nut 64 having a plurality of internal threads, which may be tightened to secure the structural elements therebelow.

Figure 6:
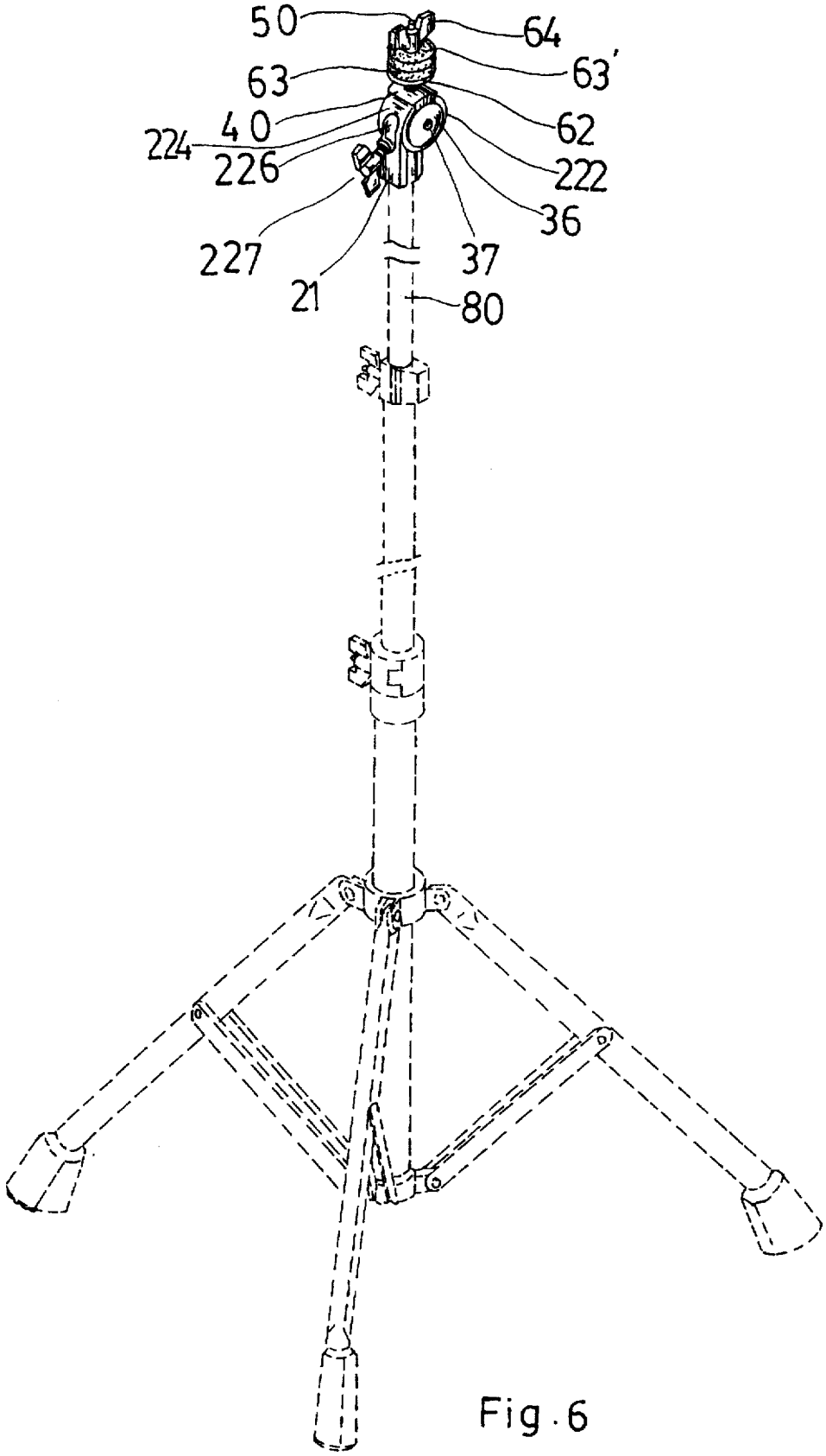
FIG. 6 shows a preferred embodiment of the present invention.
Figure 7:
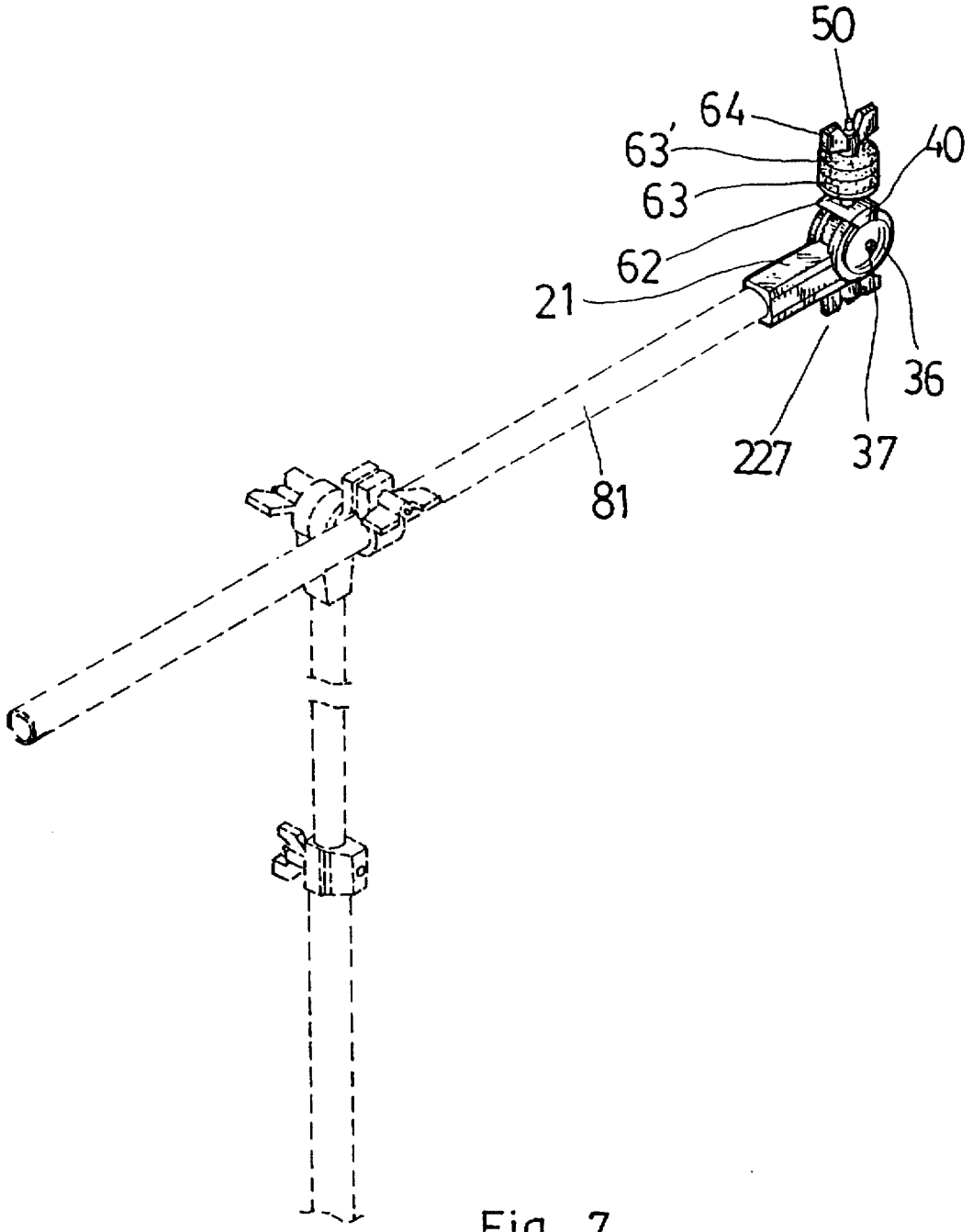
FIG. 7 shows another preferred embodiment of the present invention.

After the above-described components of the present invention have been assembled, the sleeve portion 21 of the adjusting seat 20 is joined to a cymbal mounting rod 80 (81). The cymbal mounting rod 80 may be a central main rod of a cymbal mounting frame as shown in FIG. 6. And the mounting rod 81 may be an extension rod as shown in FIG. 7. In adjusting the adjusting seat 20, the wing screw 227 is firstly loosened a little bit so that the central shaft 50 may be pulled (one way is to pull the cymbal 70 or pull the central shaft 50 in a predetermined direction with the wing nut 64 as the point of application of force). When the central shaft 50 is pulled in a predetermined direction to a predetermined angle, the slide block 40 may be brought to slide along the slide edges 222, bringing the connection element 30 to slidably rotate within the annular seat 20 synchronously until the central shaft and the cymbal mounting rod 80 or 81 has been adjusted to a predetermined ange. The wing screw 227 may then be tightened. By means of the end of the wing screw 227 urging against the urging element 23, which in turn urges against the connecting means 30, the end of which urging against the teeth 223 of the annular seat 22, the connecting means 30 may be prevented from slidably rotating. At the same time, the urging element 23 has its lateral sides urging against the connecting means 30 so that the connecting means 30 may be surely positioned in place.

In the present invention, rubber of plastics material is used to form the protective jacket 32 of the connecting means 30 for the reason that its resilience may cause the protective jacket 32 to urge tightly against the teeth 223 to achieve a good positioning effect. The aluminum push block 231 of the urging element 23 is provided to reduce the weight of the push block 231 while the iron piece 232 having a better structural strength is provided to be urged against by the wing screw 227 to achieve a better transmission of force to push the push block 231 tightly against the outer side of the protective jacket 32.

In summary, due to the cooperation between the smooth and resilient protective jacket 32 and the teeth 223 of the annular seat 22, the connecting means 30 may slidably rotate within the annular seat in a stepless manner. In other words, stepless adjustment of the angle of the cymbal 70 may be achieved. Adjustment is simple and convenient. When the wing screw 227 is loosened, no parts or components will fall down or displace. Besides, once the angle is adjusted, it is set. There is no need to deflect the angle slightly to accommodate the teeth as in the prior art. Therefore, micro-adjustment of angles is possible.

Although the present invention has been illustrated and described with reference to the preferred embodiment thereof, it should be understood that it is in no way limited to the details of such embodiment but is capable of numerous modifications within the scope of the appended claims.

I claim:

1. An improved angle adjustment device for cymbal mounting frames, comprising:

an adjusting seat having a hollow sleeve portion for fitting onto a cymbal mounting frame, said sleeve portion having a hollow annular seat provided at a top side thereof, said hollow annular seat having a large-proportion open slot formed at its peripheral surface defining two slide edges are formed at the sides of said open slot and a closed portion at the peripheral side of said annular seat, said two slide edges being annularly provided with teeth at their respective inner sides, said closed portion having a positioning groove at an inner side thereof and a projecting orifice portion at an outer side thereof, a hole of said orifice portion communicating with said positioning groove, and a wing screw with a plurality of external threads being inserted into said orifice portion with an end thereof pushing against an urging element disposed in said positioning groove;

a connecting means axially disposed in said annular seat of said adjusting seat such that said teeth of said annular seat may contact the peripheral surface of said connecting means, the ends of said connecting means being respectively provided with a connecting hole for securing thereon a sealing cover by means of a connecting element, said connecting means is radially provided with a securing hole with a plurality of internal threads;

a slide block being substantially curved, a bottom side of said slide block being provided with two grooves with respect to said slide edges of said annular seat for slidably engaging said slide edges such that said slide block may slidably displace along said slide edges, said slide block having a central through hole; and a central shaft, said central shaft having a projecting block of an enlarged diameter at a suitable position at a middle section thereof, a top end section and a bottom end section each having a plurality of external threads, said bottom end section passing through said through hole of said slide block to lock with said securing hole of said connecting means, said upper section above said projecting block having fitted thereonto a cymbal securing structure for securing a cymbal, thereby said adjusting device may achieve stepless angle adjustment.

2. An improved angle adjustment device as claimed in claim 1, wherein said connecting means has a polygonal post an outer surface thereof being wrapped in a protective jacket, said polygonal post having a connecting hole at either end thereof, and an internally threaded securing hole at a central portion of a top side thereof, said protective jacket having a hole disposed with respect to said securing hole of said polygonal post and communicating therewith.

3. An improved angle adjustment device as claimed in claim 1, wherein said two grooves of said slide block are respectively provided with at least a resisting boss for enhancing friction during positioning of said slide block and preventing said slide block from slipping freely.

* * * * *